US005249377A

United States Patent [19]

Walkhoff

[11] Patent Number: 5,249,377

[45] Date of Patent: Oct. 5, 1993

[54] SKI BOOT HAVING TENSIONING MEANS IN THE FOREFOOT REGION

[75] Inventor: Klaus Walkhoff, Kreuzlingen, Switzerland

[73] Assignee: Raichle Sportschuh AG, Kreuzlingen, Switzerland

[21] Appl. No.: 15,887

[22] Filed: Feb. 10, 1993

Related U.S. Application Data

[63] Continuation of Ser. No. 648,056, Jan. 30, 1991, abandoned.

[30] Foreign Application Priority Data

Jan. 30, 1990 [CH] Switzerland ..... 00297/90

[51] Int. Cl.[5] ..... A43B 5/04

[52] U.S. Cl. ..... 36/119; 36/120; 36/50.5

[58] Field of Search ..... 36/50.1, 50.5, 51, 54, 36/88, 93, 97, 117-121

[56] References Cited

U.S. PATENT DOCUMENTS

| | | | |
|---|---|---|---|
| 3,545,106 | 12/1970 | Martin | 36/50 |
| 3,975,838 | 8/1976 | Martin | 36/121 |
| 4,142,307 | 3/1979 | Martin | 36/50 |
| 4,408,403 | 10/1983 | Martin . | |
| 4,510,703 | 4/1985 | Eiteljorg | 36/119 |
| 4,523,395 | 6/1985 | Borsoi . | |
| 4,551,932 | 11/1985 | Schoch . | |
| 4,620,377 | 11/1986 | Pozzebon . | |
| 4,654,985 | 4/1987 | Chalmers . | |
| 4,841,649 | 6/1989 | Baggio et al. | 36/119 |

FOREIGN PATENT DOCUMENTS

| | | | |
|---|---|---|---|
| 53340 | 6/1982 | European Pat. Off. | 36/117 |
| 99504 | 2/1984 | European Pat. Off. | 36/119 |
| 316540 | 5/1989 | European Pat. Off. | 36/117 |
| 0317889 | 5/1989 | European Pat. Off. . | |
| 2341658 | 3/1974 | Fed. Rep. of Germany . | |
| 2434218 | 7/1974 | Fed. Rep. of Germany | 36/117 |
| 2800187 | 7/1978 | Fed. Rep. of Germany . | |
| 3131555 | 2/1981 | Fed. Rep. of Germany . | |
| 3919661 | 12/1989 | Fed. Rep. of Germany . | |
| 3822113 | 1/1990 | Fed. Rep. of Germany | 36/117 |
| 569438 | 10/1975 | Switzerland . | |

*Primary Examiner*—Steven N. Meyers
*Assistant Examiner*—Thomas P. Hilliard
*Attorney, Agent, or Firm*—Oliff & Berridge

[57] ABSTRACT

A boot shell (10) has a part (46) which overlaps the forefoot, in which there is a longitudinal opening (48) in the instep region of the foot. This opening is spanned twice by a cable (54) in a meander-shaped arrangement in the transverse direction. The cable (54) is anchored on the boot shell (10) by means of its one end (58) in the region of the toe (38) of the boot and furthermore guided via deflection elements (60, 62). The cable (54) is a component of a BOWDEN pull-wire (56) and ends with its other end in a tensioning device (18) which is arranged on the rear shaft part (12). By means of a rotary knob (16) of the tensioning device (18), the front part of the boot shell (10) can be optimally adapted to the foot of the wearer by drawing together the region (46) which overlaps the forefoot.

11 Claims, 3 Drawing Sheets

Fig.8
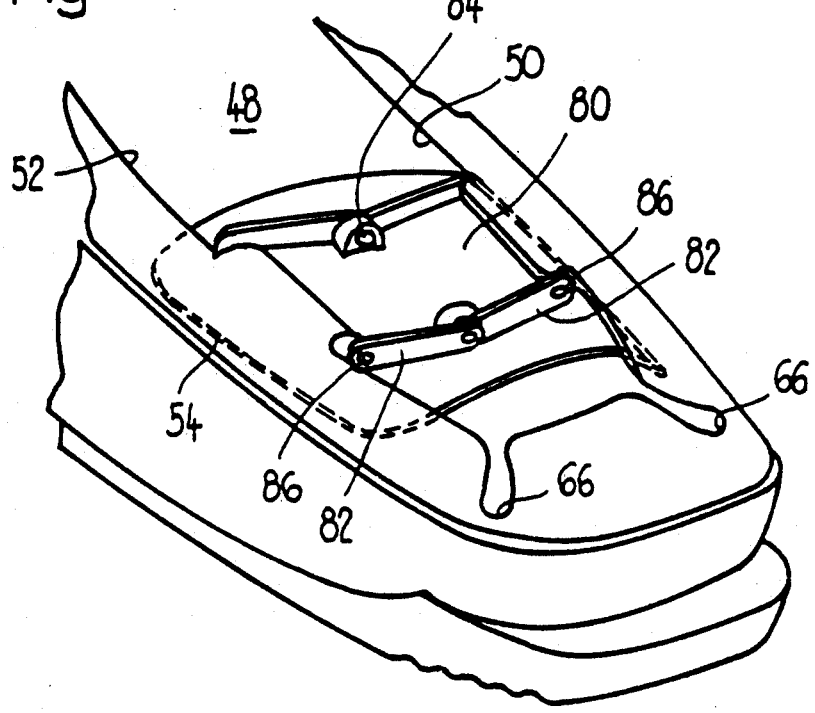
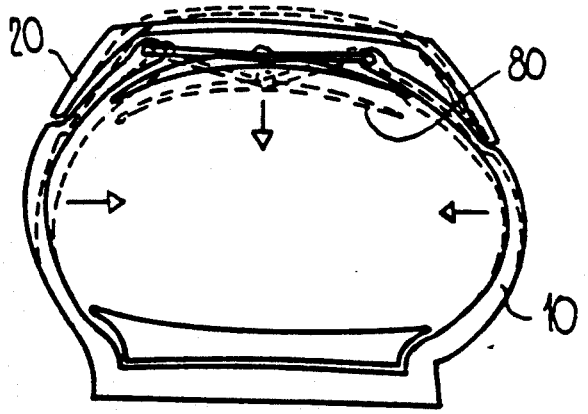
Fig.9

SKI BOOT HAVING TENSIONING MEANS IN THE FOREFOOT REGION

This is a continuation of application Ser. No. 07/648,056 filed Jan. 30, 1991, now abandoned.

BACKGROUND OF THE INVENTION

1. Technical Field

The invention relates to a ski boot of the type which adapts to the shape of a foot of the wearer.

2. Description of the Related Art

In a known ski boot of this type, the strands of a tensioning wire, which initially run below the front shaft part of the boot, are each guided through an opening in the front shaft part and then run in the shinbone region above the front shaft part (DE-A-31 31 555 and corresponding U.S. Pat. No. 4,408,403). Closing of the boot, that is to say the pressing of the front shaft part against the boot shell, is consequently necessarily linked, via the steel wire, with the drawing together of the side edges of the longitudinal opening.

SUMMARY OF THE INVENTION

The aim of the present invention is, then, to provide a ski boot of the type referred to in the introduction, which better corresponds to the requirements for individual adaptation to the shape of the foot of the wearer.

The aim is achieved, according to the invention, by means of the features described herein. In particular, the ski boot of the invention comprises: a boot shell provided with a part overlapping a forefoot region and having an opening extending in the longitudinal direction of the boot over an instep region, longitudinal edges of the opening being spaced a distance from one another; tensioning means for changing a width of the opening to adapt to a foot of a wearer, the tensioning means being provided in a region of the longitudinal edges of the opening and being connected to the part of the boot shell overlapping the forefoot region; a front shaft part, covering the boot shell in the forefoot region and a shinbone region, and connected to the boot shell in a manner capable of being lifted off from the boot shell at least by means of a section covering the shinbone region; a rear shaft part connected to the boot shell, such that the front shaft part is releasably connectable to one of the boot shell and the rear shaft part; a tensioning device, arranged on the rear shaft part, for tightening the tensioning means; and a closing arrangement, separate from the tensioning means and tensioning device, for connecting the front shaft part to one of the boot shell and the rear shaft part.

As the tensioning means and their tensioning device are independent of the closing arrangement, which connects the front shaft part to the rear shaft part or the boot shell, optimum adaptation in the instep region, even with the boot already closed, is made possible for the wearer.

The design of the closing arrangement contributes to a further improvement of the individual adaptation of the boot to the foot.

In a preferred embodiment, a single cable, sometimes also described as a wire, is sufficient for adapting the ski boot to the foot of the wearer. This cable can also span the longitudinal opening more than two times in a meander-shaped arrangement via appropriate deflection elements.

In another embodiment, two cables may be provided where it may be sufficient if each cable spans the opening only once. Additionally, by means of such an arrangement, an especially good symmetry can be achieved on clamping.

In yet another embodiment, the cable is guided to its place of action in a protected manner. As a result, there is also no friction on boot parts which are not involved. Additionally, with a BOWDEN pull-wire, deflection elements are not required in the region of its tube or jacket so that it can be run freely.

By means of a preferred embodiment, the adaptation is carried out not only laterally by drawing together the opening edges, but additionally by means of a downwardly-directed pressing movement.

By means of a subdivision of the front shaft part and the freedom of movement of the tongue part which is made possible as a result, the adaptation can be even further improved, and in addition, putting on the boot is made easier. Furthermore, the possibility is thus created of designing the cover part to be relatively rigid and the tongue part to be elastic.

In another embodiment, additional mobility is created, both upon putting the boot on and upon adaptation by means of the tensioning means.

A further embodiment of the invention brings about an automatic return or closure of the tongue part.

In still another embodiment of the invention, a fine adjustment on the one hand and a rapid release on the other hand are possible, in order to be able to relax the feet during rest periods. The reverse stop can have, for example, a catch with a ratchet wheel or also a worm with a worm wheel.

BRIEF DESCRIPTION OF THE DRAWINGS

Exemplary embodiments of the invention are explained in greater detail with reference to the drawings, in which:

FIG. 8 shows the front part of another ski boot in a perspective view; and

FIG. 9 shows the front part according to FIG. 8 in cross-section.

DETAILED DESCRIPTION OF PREFERRED EMBODIMENTS

Figure 1:
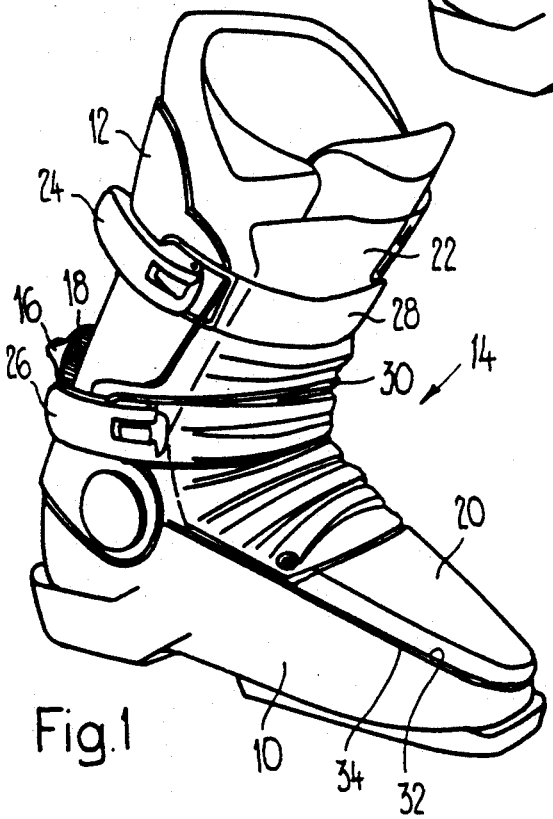
FIG. 1 shows a closed ski boot in a perspective view.

The ski boot illustrated in FIG. 1 has a boot shell 10, a rear shaft part 12 and a front shaft part 14. On the rear shaft part 12, which is essentially rigidly connected to the boot shell 10, a tensioning device 18 is arranged, which has a rotary knob 16 and the function of which is explained below referring to FIG. 3.

The front shaft part 14 is subdivided into an essentially rigid cover part 20, which covers the forefoot, and an at least partially elastic tongue part 22 which is transversely ribbed in the instep region and shinbone region. Upon closing the ski boot, which is designed as a front-entry boot, an upper buckle 24, which is arranged in the shinbone region and attached to the rear shaft part 12, serves for the tightening of a tensioning band 28 and a lower buckle 26 for the tightening of a cable or wire 30. The lower buckle 26 is fastened to the boot shell 10 in the region of the ankle joint and the cable or wire 30 runs across the front shaft part 14 in the transition between instep region and shinbone region. The cover part 20 is supported by means of its edge 32 on a shoulder 34 of the boot shell 10 and is rigidly connected to the boot shell 10.

Figure 2:
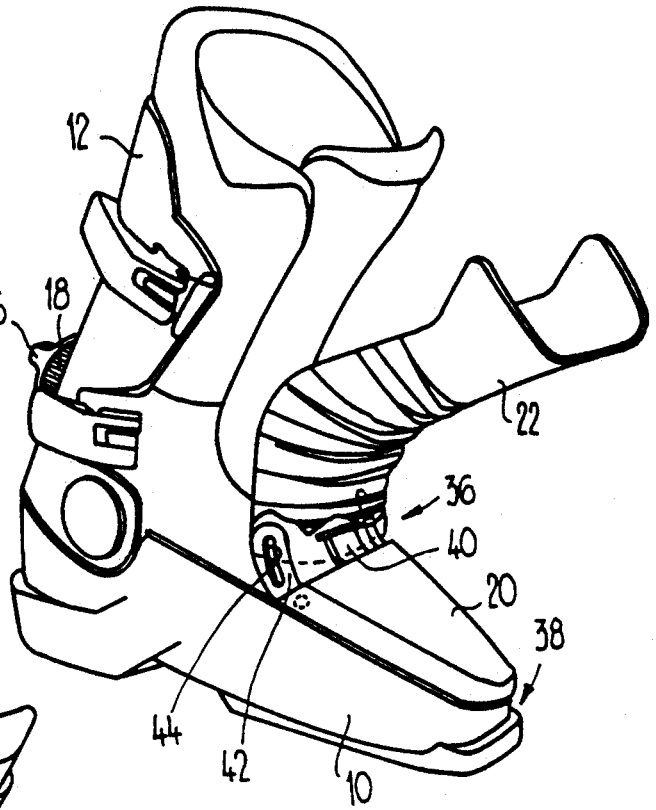
FIG. 2 shows a ski boot according to FIG. 1 but in an open state.

In FIG. 2, it can be seen that the tongue part 22 is connected to the cover part 20 via an articulation 36 so that the tongue part 22 can be pivoted towards the toe 38 of the boot to open the boot. The articulation 36 has in its central region a stop flap 40 and on each side a guide flap 42. The stop flap 40 allows the tongue part 22 not only a pivoting movement in relation to the cover part 20 but also a displacement in the longitudinal direction of the boot. The guide flaps 42 are provided with circular-arc shaped slots 44, in which link pins engage, which are arranged on the tongue part 22 but, because of the cut-away illustration, are not visible. The guide flaps 42 make possible a generous pivoting movement of the tongue part 22 for comfort when putting the boot on and guarantee smooth guidance of the tongue part.

Figure 3:
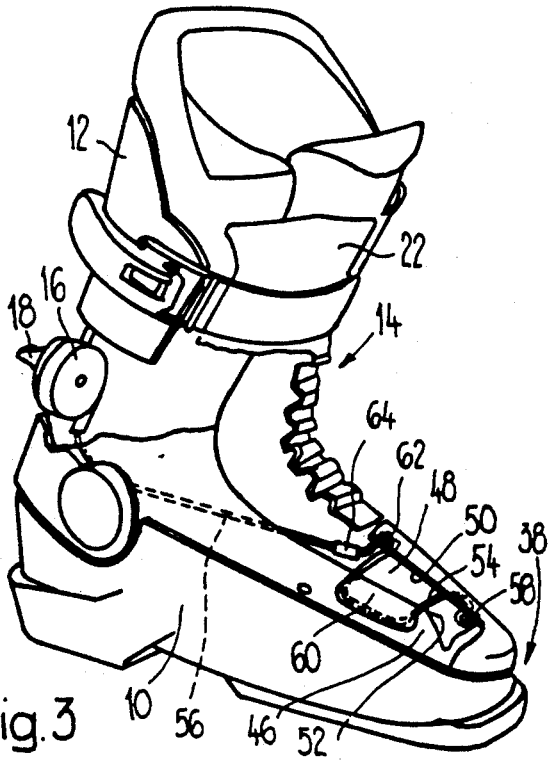
FIG. 3 shows the ski boot according to FIG. 1 with the parts illustrated partially cut away.

In FIG. 3, regions of the shaft parts 12 and 14 are illustrated cut away in order to make visible those parts located underneath. The boot shell 10 has a part 46 which overlaps the forefoot and which is provided with an opening 48 which extends in the longitudinal direction of the boot and the longitudinal edges 50 and 52 of which are at a distance from one another. The width of this longitudinal opening 48 can be reduced by means of tightening at least one wire or steel cable 54 which serves as a tensioning means.

In an exemplary embodiment illustrated, the steel cable 54, which forms part of a wire pull or a BOWDEN pull-wire 56 (i.e., a cable arranged in a flexible metallic conduit), spans the opening 48 twice in a meander-shaped arrangement transversely to the longitudinal axis of this boot. Its end 58 is anchored on one side of the opening 48 in the vicinity of the toe 38 of the boot. It is guided via deflection elements 60 and 62 which are arranged on both sides of the opening 48.

In an exemplary embodiment, the first deflection element 60 has the form of a hook which serves for tying, but is broader in order to achieve a separation, in the longitudinal direction of the boot, of the two cable sections which cross the opening 48. Such an arrangement results in a favorable distribution of the tensioning force along the length of the opening 48. The second deflection element 62 can be, for example, a mushroom-shaped pin or a deflection roller. It can also be omitted if the endpiece 64 of the BOWDEN pull-wire tube is fastened appropriately to the boot shell 10.

At its other end, the steel cable 54 is anchored in a cable drum (not shown) which is arranged in the tensioning device 18. If the tensioning device 18 is operated, by turning the rotary knob 16, the steel cable 54 is then tightened, in order thus optimally to adapt the boot shell 10 to the forefoot in the region of the latter. As that part 46 of the boot shell which overlaps the forefoot is made of an elastic material, a change in the cross-section in this region results upon the adaptation to the foot of the wearer.

Figure 4:
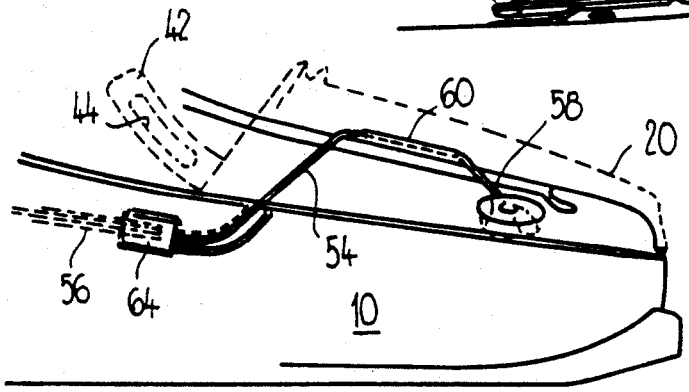
FIG. 4 shows the opened front part of a ski boot in a side view.

In FIG. 4, the endpiece 64 of the BOWDEN pull-wire 56 is arranged on the boot shell 10. The deflection element 62 shown in FIG. 3 is thus omitted. The BOWDEN pull-wire 56 has a steel jacket, in which the steel cable 54 is guided.

Figure 5:
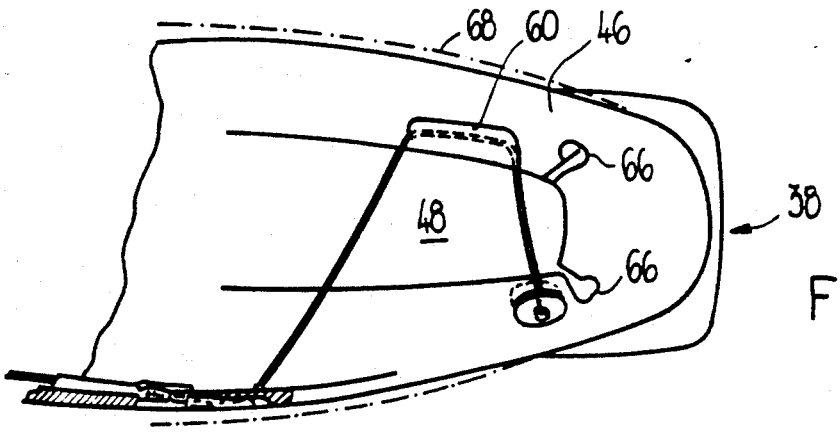
FIG. 5 shows the front part according to FIG. 4 in a plan view.

In FIG. 5, it can be clearly seen that the opening 48, to increase the elasticity, has incisions 66 in its corner regions in the region of the toe 38 of the boot. By means of a peripheral dot-dash line 68, the possible cross-sectional change in that part 46 of the boot shell 10 which overlaps the forefoot is indicated.

Figure 6:
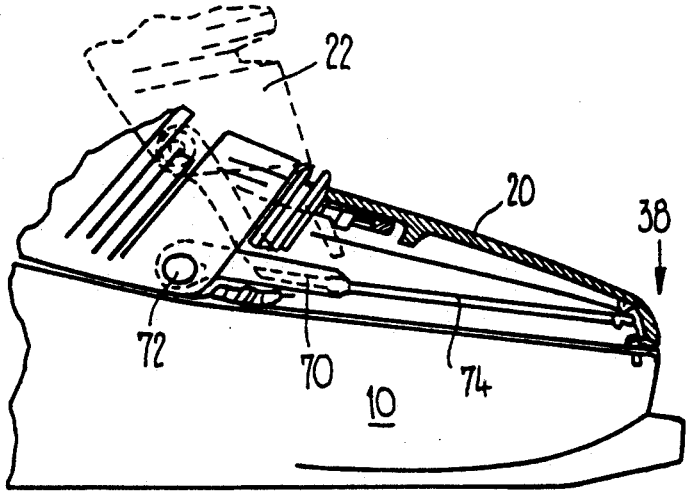
FIG. 6 shows the opened front part of another ski boot in a side view with a restoring device for the tongue part.

FIG. 6 shows an embodiment in which a restoring mechanism for the tongue part 22 is arranged in the region of the forefoot between the boot shell 10 and the cover part 20. In this arrangement, connection flaps 70 are provided on the tongue part, on the outside and on the inside respectively, parallel to the boot shell 10, which on the one hand engage at a point 72 of the tongue part 22 and on the other hand are connected to a rubber spring element 74.

Figure 7:
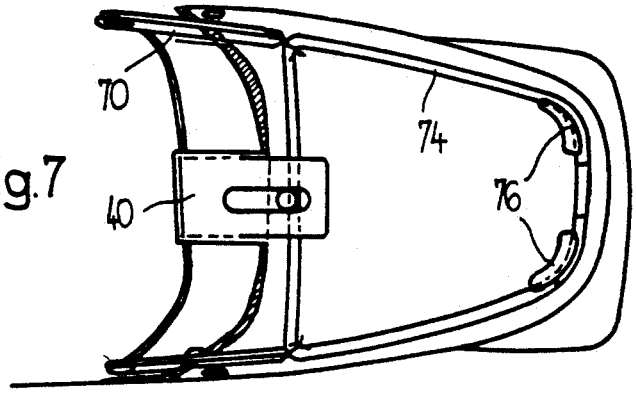
FIG. 7 shows the front part according to FIG. 6 in a plan view.

In FIG. 7, it can be seen that the rubber spring element 74 is endless and wraps around two noses 76 in the region of the toe 38 of the boot. Such an arrangement serves for the automatic restoration and closure of the tongue part 22 when the latter has been opened or pivoted away.

According to FIG. 8, the opening 48 is at least partially covered on its inner side by a pressure plate 80, on which two articulated levers 82 engage by means of their articulated joints 84. Each of the articulated levers 82 is articulated by means of both its outer ends 86 on the respectively opposite longitudinal edges 50, 52 of the opening 48.

If, by means of the wire cable 54 (not shown in FIG. 8), the longitudinal edges 50, 52 are moved toward one another in the manner described above and the width of the longitudinal opening 48 is thus reduced, the pressure plate 80 is then moved downward via the articulated levers 82 which yield downward.

FIG. 9 shows by means of dotted lines the possible cross-sectional narrowing of the front part of the boot, upon tightening by means of the tensioning device described above, from both sides as well as from the top.

The embodiments according to the invention allow an optimum adaptation of the ski boot to the foot of the wearer and in particular also with the boot closed, that is to say also with the band 28 or cable or wire 30 tightened by means of the buckles 24 or 26.

While the invention has been described with reference to particular embodiments, the invention is not intended to be limited thereto, rather those skilled in the art will recognize that variations and modifications can be made therein which are within the spirit of the invention and within the scope of the claims.

What is claimed is:

1. A ski boot, comprising:

a boot shell provided with a flexible part overlapping a forefoot region and having an opening extending in the longitudinal direction of the boot over an instep region, longitudinal edges of the opening being spaced a distance from one another;

tensioning means for changing a width of the opening to adapt to a foot of a wearer, the tensioning means being connected to the longitudinal edges of the opening in the region of the boot shell part overlapping the forefoot region to change the width of the opening only in the forefoot region;

a front shaft part, covering the boot shell in the forefoot region and a shinbone region, and connected to the boot shell by an articulating joint in a manner such that the front shaft part is capable of being lifted off from the boot shell at a section covering the shinbone region for permitting entry into the ski boot;

a non-articulating rear shaft part rigidly connected to the boot shell, such that the front shaft part is releasably connectable to one of the boot shell and the rear shaft part;

a tensioning device, arranged on the rear shaft part, and connected to the tensioning means for tightening only the tensioning means; and a closing arrangement, arranged outside of the forefoot region and functioning independently from the tensioning means and tensioning device, for connecting the front shaft part to one of the boot shell and the rear shaft part in the shinbone region.

2. The ski boot as claimed in claim 1, wherein the tensioning means runs completely below the front shaft part from the region of a toe of the boot via the instep region to the tensioning device.

3. The ski boot as claimed in claim 1, wherein the closing arrangement is arranged in the shinbone region and acts between the rear and front shaft parts, and comprises a closing device provided with a tensioning member attached to the rear shaft part.

4. The ski boot as claimed in claim 1, wherein the closing arrangement is arranged in a region of the transition from the instep region to the shinbone region, and comprises a closing device provided with a tensioning member attached to one of the rear shaft part and the boot shell.

5. The ski boot as claimed in claim 1, wherein the tensioning means comprises a single cable which, via at least one deflection element, spans the longitudinal opening at least twice in a meander-shaped arrangement transversely to the longitudinal axis of the boot and an end of the cable is anchored on one side of the longitudinal opening in the region of its end which is turned toward the toe of the boot.

6. The ski boot as claimed in claim 1, wherein the tensioning means is designed as a cable arranged in a flexible metallic conduit.

7. The ski boot as claimed in claim 1, wherein the front shaft part is subdivided into a flexible tongue part and a cover part which is connected to the part of the boot shell overlapping the forefoot, and the tongue part is connected to the cover part, along an axis which extends transversely to the longitudinal axis of the ski boot, by means of the articulating joint.

8. The ski boot as claimed in claim 7, wherein the part of the boot shell overlapping the forefoot region moves in a lateral direction when the tensioning means changes the width of the opening in response to adjustment of the tensioning device, and both the cover part and the flexible tongue part move in the lateral direction to follow, as a unit, the movement in the lateral direction of the part of the boot shell overlapping the forefoot when the tensioning means changes the width of the opening.

9. The ski boot as claimed in claim 7, wherein the tongue part is connected to the cover part displaceably in relation to the cover part and parallel to the longitudinal axis of the boot.

10. The ski boot as claimed in claim 9, wherein a spring element engages on the tongue part at an end adjoining the articulation, for bringing about a closing force.

11. A ski boot comprising:

a boot shell provided with a part overlapping a forefoot region and having an opening extending in the longitudinal direction of the boot over an instep region, longitudinal edges of the opening being spaced a distance from one another;

tensioning means for changing a width of the opening to adapt to a foot of a wearer, the tensioning means being provided in a region of the longitudinal edges of the opening and being connected to the part of the boot shell overlapping the forefoot region;

a front shaft part, covering the boot shell in the forefoot region and a shinbone region, and connected to the boot shell in a manner capable of being lifted off from the boot shell at least by means of a section covering the shinbone region;

a rear shaft part connected to the boot shell, such that the front shaft part is releasably connectable to one of the boot shell and the rear shaft part;

a tensioning device, arranged on the rear shaft part, for tightening the tensioning means; and a closing arrangement, separate from the tensioning means and tensioning device, for connecting the front shaft part to one of the boot shell and the rear shaft part;

wherein the opening is at least partially covered on its inner side by a pressure plate, on which at least one articulated lever engages by means of an articulated joint, the lever being articulated by means of each of two ends on one lateral edge respectively of the opening so that, upon drawing together of the lateral edges for adaptation to the foot, the lever is lowered onto the pressure plate.

* * * * *